United States Patent [19]

Bohnes et al.

[11] 4,185,873

[45] Jan. 29, 1980

[54] MACHINE FOR MECHANICALLY ADVANCING CLEAN CUT UNDERGROUND MINING GALLERIES OF VARIOUS PROFILES

[75] Inventors: Karlheinz Bohnes, Bochum; Kuno Guse, Dortmund, both of Fed. Rep. of Germany

[73] Assignee: Bochumer Eisenhutte Heintzmann GmbH & Co., Bochum, Fed. Rep. of Germany

[21] Appl. No.: 913,082

[22] Filed: Jun. 6, 1978

[30] Foreign Application Priority Data

Jun. 11, 1977 [DE] Fed. Rep. of Germany ..... 2726445

[51] Int. Cl.[2] ..... E21D 9/10

[52] U.S. Cl. ..... 299/31; 299/60; 299/61

[58] Field of Search ..... 299/11, 31, 71, 60, 299/61; 175/94, 230

[56] References Cited

U.S. PATENT DOCUMENTS

| | | | |
|---|---|---|---|
| Re. 24,965 | 4/1961 | Kirkpatrick | 299/31 |
| 3,386,520 | 6/1968 | Lawrence et al. | 299/31 X |
| 3,446,535 | 5/1969 | Lauber | 299/71 X |
| 3,643,998 | 2/1972 | Williamson | 299/31 |
| 3,840,271 | 10/1974 | Sugden | 299/31 |
| 3,920,277 | 11/1975 | Winberg et al. | 299/31 |
| 3,979,151 | 9/1976 | Plummer | 299/31 |

*Primary Examiner*—Ernest R. Purser
*Attorney, Agent, or Firm*—Michael J. Striker

[57] ABSTRACT

A method for mechanically advancing clean cut underground mining galleries of various profiles, in which during a primary phase of the operation a pilot excavation of circular cross-section smaller than the final desired cross-section of the mining gallery is carried out and in which during a secondary phase of the operation, overlapping in time with the primary phase, the pilot excavation is widened to the desired finished cross-section of the mining gallery; and a machine for carrying out the method.

27 Claims, 6 Drawing Figures

MACHINE FOR MECHANICALLY ADVANCING CLEAN CUT UNDERGROUND MINING GALLERIES OF VARIOUS PROFILES

BACKGROUND OF THE INVENTION

The present invention relates to a method for mechanically advancing clean cut underground mining galleries of various profiles, as well as to a machine for carrying out the method.

Technology has reached the stage where underground mining galleries are extended by means of full-cut machines. Admittedly such machines are capable of creating a clean cut gallery profile but the profile is limited to a circular shape. Moreover, the dimensions of the profile are determined by the diameter of the full-cut tools. Therefore galleries with different profiles must be made by full-cut machines specific for such profile. However arched, elliptical or substantially rectangular gallery profiles cannot be made with such full-cut machines. Moreover, the technique presents a problem in that simultaneously with the extension of galleries, the gallery supports must be supplied and installed. The reason for this problem is that a full-cut machine occupies a large space in the mining gallery, that is it practically fills the cross-section thereof.

A method is further known in which partial-cut machines are used to extend mining galleries, which machines are capable of creating profiles different from a circular one. The dimensions of such profile are also fairly optional. However, such partial-cut machines are not capable—irrespective of the gallery profile—to produce a sufficiently clean cut gallery profile to make it possible to install the gallery supports. The irregular cutting is e.g. caused by the hydraulic controls of such machines and by the usually relatively long booms, at the ends of which the tools are mounted. The irregularities are made worse by the circumstance that the partial-cut machines cannot be as freely rigged in the mining gallery as one would wish. Furthermore, most partial-cut machines are not capable of making a tangential surface cut on account of the fact that the machines with the attached cutting booms, are positioned in the middle of the gallery. Due to the kinematic of such machines, sawtooth-shaped profiles in the mine gallery walls and therefrom resulting removal of rocks beyond the desired profile cannot be avoided. Such undesirable extended cavities require refilling and result in a distortion of the mine roof support to be set. In addition it is disadvantageous that a relatively large delay in setting the mine roof support cannot be avoided since the latter can be installed only after all the rubble resulting from gallery cutting has been collected and removed. The stability of the geological formations will thereby necessarily detrimentally affected.

Finally, using the old methods and machinery, great difficulties arise in correlating the excavation work and the installation of mine roof supports in such a way to insure that as many different activities as possible may be carried out at the same time. Usually excavation must be stopped while placing the mine roof supports. The progress theoretically possible is thereby greatly impaired.

SUMMARY OF THE INVENTION

It is an object of the present invention to provide a method as well as a machine to mechanically advance clean cut galleries of various profiles in underground mining which make it possible to more or less simultaneously carry out excavation and support work, while maintaining the stability of the walls of the mining gallery and avoiding delays in supporting the same irrespective of the shape and dimensions of the gallery cross-section.

With these and other objects in view, which will become apparent as the description proceeds, the method according to the present invention of mechanically advancing clean cut underground mining galleries of various profiles mainly comprises the steps of making during a primary phase of the method a pilot excavation of circular cross-section smaller than that of the desired final cross-section of the mining gallery, and widening during a secondary phase of the method the pilot cross-section downstream of the pilot excavation to the desired cross-section, with the secondary phase overlapping in time the primary phase.

The method of the present invention combines the advantages of the full-cut machine producing a precise contour of circular-cross-section, with the advantage of the partial-cut machines, which has a great adaptability as to shape and dimensions of the gallery profile to be made. The method takes place in two phases which are spatially separated from each other which, however, overlap in time. The method makes it possible to ream the profile which remains after the pilot excavation has been made to the desired gallery cross-section in a clean cut way. In this way gallery support work may be carried out soon afterwards and the supports may be installed to the best advantage right against the finished wall. Support work may be carried out with little delay without thereby interrupting the continuous advance of the mining gallery. Compared with the old method, either with full-cut or with partial-cut machines and explosives, support work is considerably less delayed which improves the stability of the rock formations. In addition, with the method according to the present invention the up to now necessary back filling is avoided since an excavation beyond the desired cross-section of the mine gallery will not occur.

A preferred form of the method according to the present invention is carried out by making the circular pilot excavation by full-cut tools during the primary phase and by widening the pilot excavation to the desired cross-section during the secondary phase by clean-cutting tools mounted on the rear end of the support for the full-cut tools, which support may be secured in position in the pilot excavation.

The machine for carrying out the method mainly comprises elongated support means carrying on the front end thereof full-cutting tools for production of the pilot excavation of circular cross-section smaller than the desired final cross-section of the mining gallery, clean-cutting tools carried on the rear end of the support means for widening the pilot excavation to the desired cross-section of the mining gallery, and means on the support means for bracing and for stepwise advancing the support means in the pilot excavation.

The machine according to the present invention combines therefore the working principle of a full-cut machine and a partial-cut machine in such a manner that the support means for the full-cut machine forms at the same time also the support or abutment of the partial-cut machine. By making an initial pilot excavation in the primary operational phase, the support means may be simply and precisely braced by means of bracing elements coordinated therewith in the pilot excavation which has a smaller circular cross-section than the desired finished cross-section of the mine gallery. The exact bracing of the support means will assure that the clean-cutting tools mounted on the rear end thereof will also have a fixed support. Therefore, it is possible to ream the remaining profile around the pilot excavation to the desired clean cut cross-section during the secondary operational phase, which spatially follows the primary phase but takes place more or less simultaneously.

Furthermore, the fitting of clean-cutting tools at the rear end of the support means makes it possible to incorporate all necessary drive units in the support means and thus in the pilot excavation. On the rear end of the pilot excavation there are then only the clean-cutting tools with the necessary supports. This fact has the considerable advantage that immediately behind the clean-cutting tools, the mine gallery supports may be applied and effectively installed against the walls due to the perfeact surface cut of the latter. Almost the total cross-section of the mining gallery is available for the transport and installation of the supports. The gallery profile is only obstructed by the equipment for the supply of power to the machine and for the removal of rubble. Therefore, it is possible to use highly mechanized support equipment, resulting in a continuous support operation simultaneously with the excavation work.

According to a further advantageous feature of the machine according to the present invention, the clean-cutting tools are mounted on a rotating carrier body radially adjustable with respect thereto, with the axis of rotation of the carrier body parallel to the longitudinal axis of the support means. In a preferred arrangement the axis of rotation of the carrier body is coaxial with the axis of rotation of the full-cut tools. The mounting of the clean-cut tools on a carrier body which rotates in a vertical plane and the radial adjustability of the clean-cutting tools relative to the carrier body permits to produce the desired mine gallery without any difficulties. The clean-cutting tools may be guided manually by means of a template representing the desired profile of the mining gallery. It is, however, also possible to provide a fully automatic steering of the clean-cutting tools in dependence on the respective rotational angle of the carrier body by means of a predetermined cutting profile controlled by a known control device. The machine of the present invention provides the additional advantage that by temporarily stopping of the carrier body and corresponding adjustment of the clean-cutting tools it is possible to provide lateral cut outs in the rock formation extending beyond the desired contour of the mine gallery.

A further advantage of the invention is that the direction of rotation of the carrier body and the clean-cutting tools thereon, on the one hand, and the direction of rotation of the full-cut tools, on the other hand, are opposed to one another. This effectively compensates for the torque moment of the full-cut tools relative to the support means, thus decreasing the stress on the elements provided to brace the support means in the pilot excavation. This in turn will improve the stability of the surrounding rock formation and decrease the effective vibration since it is possible to work with less stress.

According to a further feature of the present invention, the carrier body is movable relative to the support means in longitudinal direction of the pilot excavation. The carrier body is movable in this direction by at least one thrust piston unit which preferably is hydraulically operated. The mobility of the carrier body relative to the support means renders the progress of the full-cut tools to a certain extent independent from the following clean-cutting tools, especially when the geological formation is of uneven density or when temporary breakdowns of some part of the machinery occurs. Instead of one thrust piston unit between the carrier body and the support means, several such units may evidently be used. If the support means has a substantially cylindrical configuration, then it will be advantageous to use three or four such units circumferentially spaced and parallel to the axis of the support means.

It is further recommended that the carrier body be disk-shaped and fitted to the rear end of the support means in a way to enable it to turn. Suitably designed slide or roller bearings are used for this purpose.

In this connection it is advantageous to provide on the carrier body, on the side thereof facing away from the front end of the support means an internal gear ring of large diameter in mesh with at least one motor driven pinion. Preferably two diametrically opposed pinions mesh with the annular gear and these pinions are preferably driven by hydraulically actuated motors.

The drive units for the carrier body are fitted radially offset from the axis of rotation of the carrier body in order that the drive units have to produce less torque on account of the longer lever arms. Moreover, the drive units may then be designed smaller. Of course it is also possible to install three or four pinions instead of two diametrically opposed pinions, with suitable drive motors, preferably hydraulically actuated motors. The motors and pinions are mounted on a frame or girder fixed to the support means.

According to an advantageous embodiment of the present invention, the clean-cut tools are mounted on the free end of a sliding carriage which is radially adjustable relative to the carrier body. The sliding carriage is thereby adjustable by at least one cylinder-and-piston unit and guided on radial guides on the carrier body. Preferably the carriage is U-shaped with the two legs of the U-shaped carriage arranged to opposite sides of conveyor means passing in longitudinal direction through the support means. Thereby it may be advantageous to arrange one thrust piston unit parallel to each leg of the U-shaped carriage.

The radial movement of the carriage is controlled by preferably hydraulically operated cylinder-and-piston units in correspondence with the respective angular position of the carrier body in order to obtain the desired final contour of the mining gallery. The control of the cylinder-and-piston units can thereby be carried out according to a template or fully automatically by means of a program fed into a control device.

If certain tools, for instance, hard metal bits, make it necessary to maintain a preset cutting angle along the total cutting distance, then these cutting tools are mounted at the end of the sliding carriage pivotable around an axis extending in the longitudinal direction of the mining gallery. It is then preferable that the clean-cutting tools are pivoted about this axis by at least one thrust piston unit which may be hydraulically actuated.

According to another advantageous embodiment according to the present invention, the clean-cutting tools are mounted on the free end of at least one boom arranged radially tiltable in the rotational plane of the carrier body, whereby it is useful to have the pivoting shaft of the boom situated in the region of the periphery of the carrier body.

It is preferable to have two diametrically opposed booms on the carrier body, each tiltable by at least one thrust piston unit which is preferably hydraulically operated. The piston units are supported by the carrier body so that the tiltable booms make it possible for the clean-cutting tools to ream the remainder of the profile around the pilot excavation, maintaining the particular preset angles and to make a clean cut surface. With this embodiment it is possible to achieve all the usual gallery profiles, including door jamb galleries.

According to the present invention, the clean-cutting tools may be constituted by milling cutters which are preferably hydraulically driven. In this case it is further advantageous if the clean-cutting tools consisting of milling cutters are mounted directly on the drive shafts of the drive motors which are fitted at the end of the sliding carriage or the booms.

To facilitate an effective reaming of remaining rock, the invention further provides that the action of the milling cutters is assisted by pressurized water. Depending on the characteristics of the rock formation, water under pressure may be fed continuously or pulsewise into the region of operation of the milling cutters.

On the other hand, the clean-cutting tools may also consist of slotting chisels which may be arranged offset with respect to each other. Such slotting chisels may have cutting edges of hard metal.

To feed the rock loosened by the clean-cutting tools onto the conveyor running in longitudinal direction through the support means, the invention further provides loading means, for instance loading shovels mounted on the periphery of the carrier body.

Finally an advantageous feature of the present invention is that the support means has two longitudinally offset, relatively movable groups of radially adjustable, large surface bracing elements. The bracing elements of each group may be fitted in a star shape, as seen in a vertical cross-section of the pilot excavation, so that the elements simultaneously assume a function of temporary support around the pilot excavation. Each of the groups may be advanced in the axial direction of the support means while the other of the groups is stationarily held thereon by hydraulically operated cylinder-and-piston units which are arranged on the periphery of the cylindrical support means and parallel to the axis of the latter.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
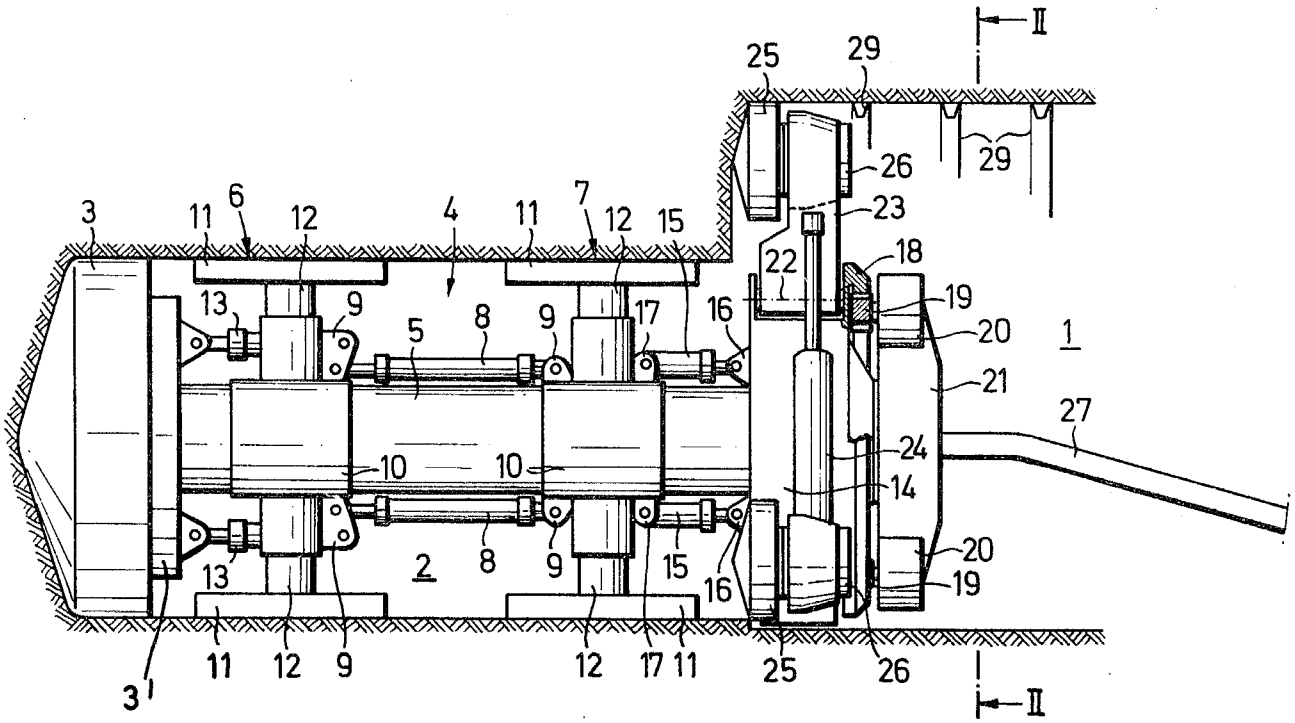
FIG. 1 illustrates a vertical cross-section through the end of an underground mining gallery and a side view of the machine advancing in the gallery, shown partially in section.
Figure 2:
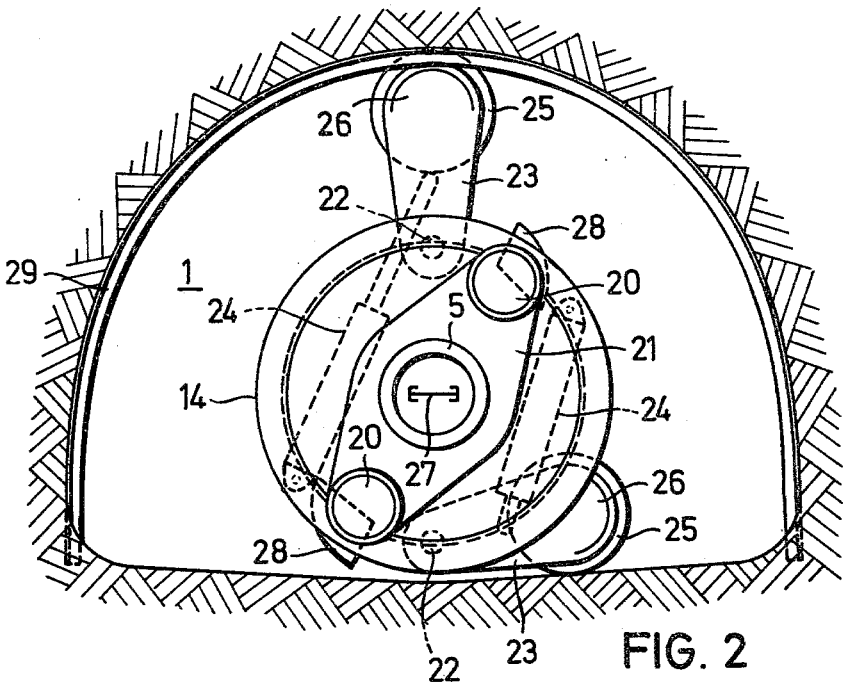
FIG. 2 is a vertical cross-section taken along the line II—II of FIG. 1.

Referring now to the drawing and more specifically to FIGS. 1 and 2 of the same, it will be seen that the arched respectively horseshoe-shaped gallery 1 is advanced in two phases. In a primary phase, a circular pilot excavation 2 is made of a cross-section which is smaller than the desired finished cross-section of the mining gallery. In a secondary phase, which spatially follows but occurs more or less simultaneously with the primary phase, the circular cross-section 2 is reamed in a clean fashion station to the final gallery cross-section. The pilot excavation 2 is made by means of full-cut tools 3 rotatably mounted about a horizontal longitudinal axis at the front end of elongated support means 4. To simplify the drawing, the details of the tools are not shown.

The support means 4 has a central preferably cylindrical body 5 and two groups of bracing elements 6 and 7 arranged longitudinally spaced from each other on the body 5. One of the groups is movable in longitudinal direction relative to the body 5 and the other of the groups is preferably fixedly mounted on the latter. In order to move the movable group relative to the other two hydraulically operated cylinder-and-piston means 8 are provided which are respectively hingedly connected to brackets 9 which in turn are mounted on sleeves 10 encompassing the body 5. One of the sleeves 10 is arranged slidable on the body 5 in longitudinal direction of the latter.

Both groups of bracing elements 6 and 7 have four large surface, plate-like bracing members 11 which are bent in accordance with the contour of the pilot excavation and which may be braced against the excavation wall by means of extensible and collapsable hydraulically actuated cylinder-and-piston units 12. By corresponding collapsing and extending the cylinder-and-piston units 8 between the brackets 9 of the bracing element groups 6 and 7, on the one hand, and by corresponding extending and collapsing the cylinder-and-piston units 12 between the sleeves 10 and the bracing elements 11, on the other hand, the support means 4 may be properly braced within the pilot excavation 2 or stepwise advanced in the latter. The body of the full-cutting tools 3 abuts with a rear face thereof against a bearing plate 3' rotatable relative to the latter and the bearing plate 3' together with the full cut tools 3 may be advanced in axial direction of the body 5 relative to the latter by hydraulically operated cylinder-and-piston units 13 extending between the bearing plate 3' and the adjacent group of bracing elements 6.

The rear end of the support means 4 supports, in a manner not shown, a disk-shaped carrier body 14 which is arranged for rotation in a plane normal to the longitudinal axis of the support means 4. The carrier body 14, respectively the bearing means thereof, are mounted movable relative to the support means 4 by means of hydraulically actuated cylinder-and-piston units 15.

The cylinder-and-piston units 15 are hingedly connected, on the one hand, by brackets 16 on the bearing means of the carrier body 14 and, on the other hand, by brackets 17 to the sleeve 10 of a bracing element group 7.

On the side facing away from the pilot excavation 2, the carrier body 14 is provided with an annular internal gear 18. Two diametrically opposed pinions 19 are in mesh with the annular gear, and these pinions are driven by hydraulically actuated motors 20 mounted on a rhombic girder 21 which is immovably fixed on an extension of support means 14, which extension projects through an opening in the carrier body 14.

The body of the full-cutting tools 3 may be rotated in the same manner as the carrier body 14, that is an internal annular gear may be connected to the body of the tools 3 and the annular gear may be rotated by a pair of pinion which are in turn driven by hydraulic motors mounted on the bearing plate 3'.

Two booms 23 tiltable in the plane of rotation of the carrier body 14 are mounted in the region of the periphery of the latter tiltable about axes 22 extending parallel to the longitudinal axis of the cylindrical body 5. The booms 23 are tilted by hydraulically actuated cylinder-and-piston units 24 which are articulatedly connected to the booms 23 and to the carrier body 14. Hydraulically operated drive motors 26 are mounted in end sections of the booms 23, respectively, and milling cutters 25 are respectively mounted on the shafts of the drive motors 26 for rotation therewith and projecting forwardly from the drive motors.

FIGS. 1 and 2 illustrate further conveyor means 27 passing in longitudinal direction through the cylindrical body 5 of the support means 4 and serving to transport rocks cut loose by the full-cutting tools 3 in rearward direction and into not illustrated subsequent conveyor means extending along the cut-out mining gallery.

FIG. 2 shows further shovels 28 fitted adjacent the outer periphery of the carrier body 14, which shovels collect the rocks cut loose by the milling cutter 25 and also deposit the same onto the conveyor 27 running through the support means 4.

To simplify the drawing, the necessary conduits for supply of water under pressure to the various cylinder-and-piston units and hydraulic motors are not shown in the drawing.

Finally the drawing shows also mine roof supports 29 which are mounted immediately behind the contour cut tools 25 and which are effectively applied against the wall since the milling cutters produce a clean surface cut when reaming the rock remaining around the pilot excavation 2.

Figure 3:
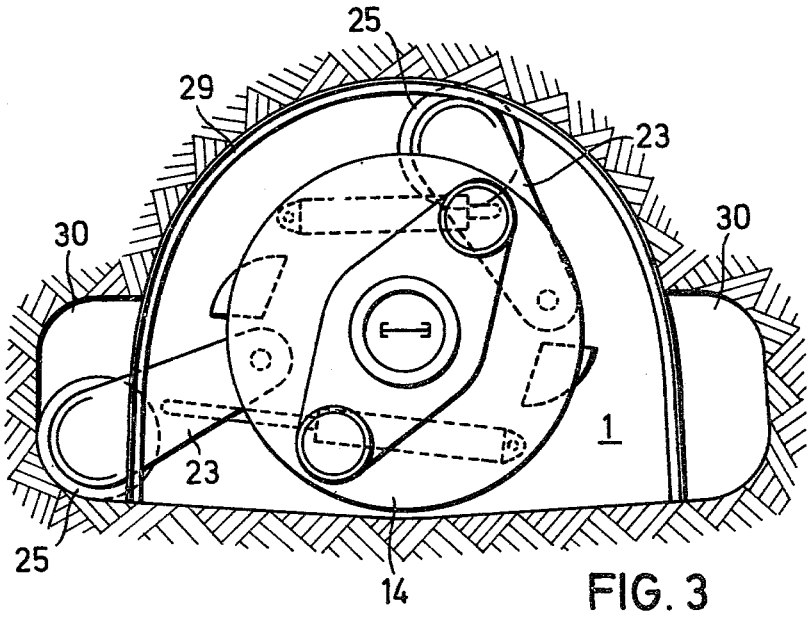
FIG. 3 is another vertical cross-section of the mining gallery in the region of lateral cut-outs extending beyond the profile, with the machine seen from the rear.

FIG. 3 shows the machine illustrated in FIGS. 1 and 2 in an area of the mining gallery 1 in which lateral cavities 30 extending beyond the desired contour of the main gallery should be provided. As can be seen from FIG. 3, the milling cutters 25 fitted at the ends of the pivotable booms 23 make it also possible to excavate such lateral extensions 30.

Figure 4:
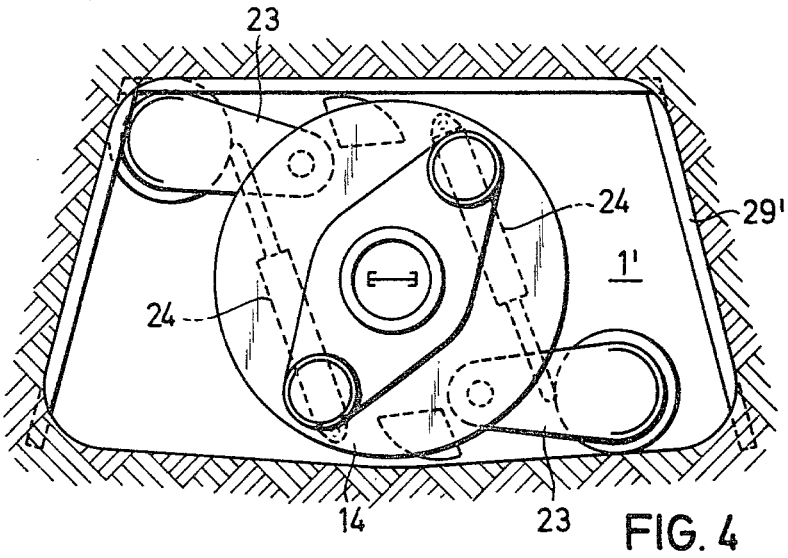
FIG 4 illustrates in vertical cross-section the machine of FIG. 1 producing a rectangular gallery with door jamb support.

FIG. 4 illustrates the machine according to FIG. 1 in a trapezoid-shaped gallery 1' with door jamb supports 29'. This Figure also shows that it is possible by actuating the cylinder-and-piston units 24 which pivot the booms 23 to produce also a clean cut gallery profile of the shape shown in FIG. 4.

Figure 5:
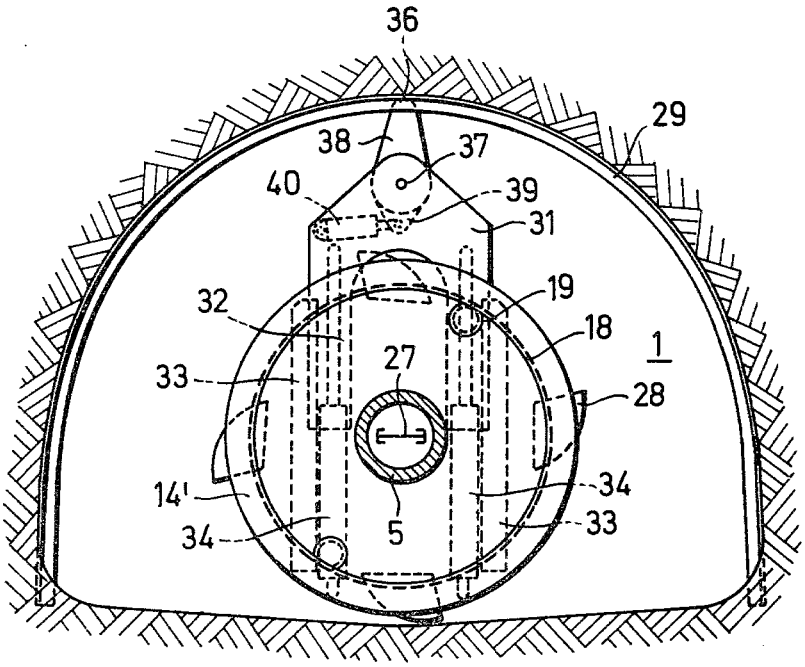
FIG. 5 is a vertical cross-section through the mining gallery and showing a machine according to a further embodiment, the cross-section being taken along the line V—V of FIG. 6.
Figure 6:
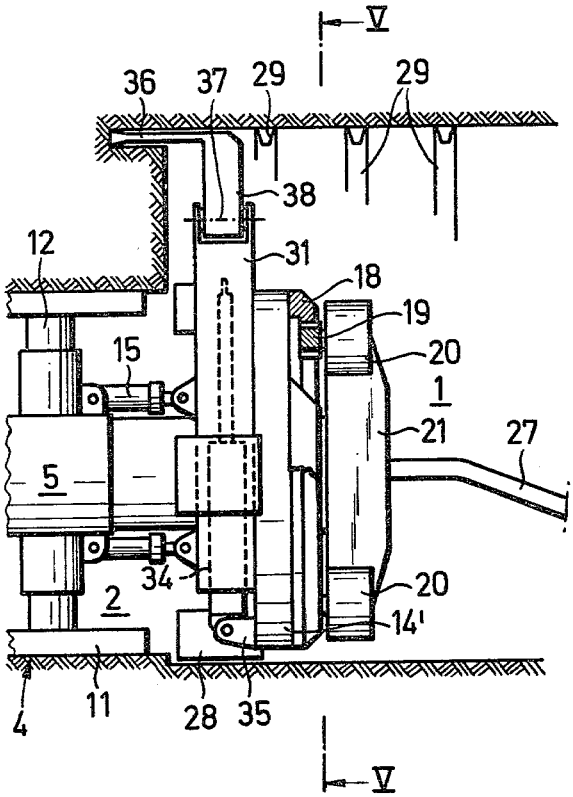
FIG. 6 is a vertical cross-section through the gallery of FIG. 5 with a partial view of the machine in partial section.

FIGS. 5 and 6 illustrate another embodiment of the machine according to the present invention which corresponds with respect to essential parts of it to the machine shown in FIG. 1. Especially the construction of the support means 4 and that of the drive arrangement for the rotatable carrier body 14 on the rear end of the support means 4 are constructed in the same manner as shown in FIG. 1. Therefore the complete picture of the full-cut unit braced in the pilot excavation is not shown in FIGS. 5 and 6.

The embodiment shown in FIGS. 5 and 6 deviates however from the above-described embodiment in that this embodiment does not include tiltable booms on the carrier body, but this embodiment includes instead of the tiltable booms a substantially U-shaped carriage 31 which is mounted and radially guided on the carrier body 14'.

As shown in FIGS. 5 and 6 the two legs 32 of the U-shaped carriage 31 encompass the central body 5 of the support means 4 and are guided in corresponding radial guides 33 provided on the carrier body 14'. The carriage 31 may be moved along the guides 33 by means of two hydraulically operated cylinder-and-piston units 34 which are arranged parallel to the legs 32 of the carriage and which are connected, on the one hand, to the carriage 31 and, on the other hand, to brackets 35 on the carrier body 14'.

A chisel-like clean-cutting tool 36 is mounted tiltable about a tilting axis 37 extending parallel to the longitudinal axis of the body 5 in the region of the free end of the carriage 31. The shank 38 of the tool 36 has an extension 39 to which a hydraulically operated cylinder-and-piston unit 40 is connected, which in turn finds an abutment on the carriage 31. By means of the cylinder-and-piston unit 40 it is possible to maintain an optimal cutting angle of the tool during the complete turn of the carrier body 14'.

It will be understood that each of the elements described above, or two or more together, may also find a useful application in other types of a method and machine for mechanically advancing clean cut underground mine galleries of various profiles, differing from the types described above.

While the invention has been illustrated and described as embodied in a method and machine for mechanically advancing clean cut underground mine galleries of various profiles in which during a primary phase of the operation a pilot excavation of circular cross-section smaller than the final desired cross-section of the mining gallery is carried out and in which during a secondary phase of the operation, overlapping in time is a primary phase, the pilot excavation is widened to the desired finished cross-section of the mining gallery, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features, that from the standpoint of prior art, fairly constitute essential characteristics of the generic or specific aspects of this invention.

What is claimed as new and desired to be protected by Letters Patent is set forth in the appended claims:

1. In a machine for mechanically advancing clean-cut underground mining galleries of various profiles, a combination comprising elongated support means having a longitudinal axis, a front end and a rear end; full-cut tools carried by said front end of said support means for cutting a pilot excavation of circular cross-section smaller than the desired final cross-section of the mining gallery; a rotatable carrier body having an axis of rotation parallel to said longitudinal axis; clean-cut tools carried at said rear end of said support means for widening said pilot excavation to the desired cross-section of the mining gallery, said clean-cutting tools being operatively connected to said carrier body adjustable in radial direction of the latter; and means on said support means for bracing and for advancing said support means in said pilot excavation.

2. A combination as defined in claim 1, wherein said full-cut tools are rotatable about said longitudinal axis of said support means and wherein said axis of rotation of said carrier body is coaxial with said longitudinal axis.

3. A combination as defined in claim 1, and including first drive means cooperating with said carrier body for rotating the same in one direction relative to said support means and second drive means cooperating with said full-cut tools for rotating the same in a direction opposite to said one direction.

4. A combination as defined in claim 1, and including means operatively connected to said support means and said carrier body for moving the latter in direction of said longitudinal axis relative to said support means.

5. A combination as defined in claim 4, wherein said moving means comprise at least one cylinder-and-piston unit interconnected between said carrier body and said support means.

6. A combination as defined in claim 1, wherein said carrier body is disk-shaped and rotatably mounted on said rear end of said support means.

7. A combination as defined in claim 1, and including means for rotating said carrier body about said axis, said rotating means comprising a large diameter internal gear ring mounted on that side of said carrier body which faces away from said front end of said support means and at least one driven pinion meshing with said gear ring.

8. A combination as defined in claim 7, wherein two through 180° displaced pinions meshing with said gear ring are provided and including motor means for rotating said pinions.

9. A combination as defined in claim 8, and including at least one boom mounted on said carrier body tiltable about a tilting axis extending parallel to said longitudinal axis, said boom having a free end on which said clean cutting tool is mounted.

10. A combination as defined in claim 9, wherein said carrier body is in the form of a circular disk and wherein said tilting axis is arranged in the region of the outer periphery of said disk.

11. A combination as defined in claim 9, wherein two through 180° displaced booms are provided each mounted on said carrier body tiltable about a respective tilting axis extending parallel to said longitudinal axis and each having a free end on which one clean cutting tool is mounted.

12. A combination as defined in claim 9, and including a cylinder-and-piston means for tilting said boom about said tilting axis.

13. A combination as defined in claim 8, wherein said motor means comprise a hydraulically operated motor for each of said pinions.

14. A combination as defined in claim 1, and including a carriage mounted on that side of said carrier body which faces away from said support means radially adjustable with respect to said carrier body, said carriage having a free end on which at least one clean-cutting tool is mounted.

15. A combination as defined in claim 14, and including guide means on said carrier body for guiding said carriage in radial direction and at least one cylinder-and-piston unit operatively connected between said carrier body and said carriage for moving the latter along said guide means.

16. A combination as defined in claim 15, wherein said carriage is U-shaped and having a pair of legs guided by said guide means, and including conveyor means extending axially through said support means and between said legs of said carriage.

17. A combination as defined in claim 16, wherein two cylinder-and-piston units are provided for moving said carriage along said guide means, said cylinder-and-piston units are respectively arranged substantially parallel to said legs of said carriage.

18. A combination as defined in claim 14, wherein said at least one clean-cutting tool is mounted on said free end of said carriage tiltable about a tilting axis extending parallel to said longitudinal axis.

19. A combination as defined in claim 18, and including cylinder-and-piston means connected to said carriage and said clean-cutting tool for tilting the latter about the tilting axis.

20. A combination as defined in claim 1, wherein said clean-cutting tools are constituted by milling cutters.

21. A combination as defined in claim 20, and including hydraulic motors for rotating said milling cutters.

22. A combination as defined in claim 20, and including drive means for rotating said milling cutters and comprising a motor for each of said milling cutters and having a drive shaft on which the respective milling cutter is mounted for rotation therewith.

23. A combination as defined in claim 20, and including water jets for supporting the action of said milling cutters.

24. A combination as defined in claim 1, wherein said clean cutting tools comprise slotting chisels.

25. A combination as defined in claim 1, wherein said carrier body is provided on its circumference with loading means.

26. A combination as defined in claim 25, wherein said loading means comprise loading shovels arranged circumferentially spaced from each other in the region of the periphery of said carrier body.

27. A combination as defined in claim 1, wherein said means for bracing and for advancing said support means comprise two groups of plate-shaped elements spaced in direction of said longitudinal axis from each other, means mounting one of said groups on said support means movable in direction of said longitudinal axis relative to the other of said groups, means for pressing said elements of each group against the surface of said pilot excavation, and means for moving the movable mounted means relative to the other of said mounting means.

* * * * *